US010626688B2

(12) United States Patent
Eliseev

(10) Patent No.: US 10,626,688 B2
(45) Date of Patent: Apr. 21, 2020

(54) SHOE ISOLATION SYSTEM AND METHOD FOR ISOLATING A SHOE

(71) Applicant: Vasily G. Eliseev, Richmond, TX (US)

(72) Inventor: Vasily G. Eliseev, Richmond, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/871,533

(22) Filed: Jan. 15, 2018

(65) Prior Publication Data

US 2019/0218882 A1 Jul. 18, 2019

(51) Int. Cl.

| | |
|---|---|
| ***E21B 21/10*** | (2006.01) |
| ***E21B 33/127*** | (2006.01) |
| ***E21B 17/14*** | (2006.01) |
| ***E21B 43/08*** | (2006.01) |
| ***E21B 23/06*** | (2006.01) |
| ***E21B 21/00*** | (2006.01) |
| ***E21B 43/18*** | (2006.01) |
| ***E21B 21/08*** | (2006.01) |
| ***E21B 21/12*** | (2006.01) |
| ***E21B 23/01*** | (2006.01) |

(52) U.S. Cl.

CPC ..... *E21B 21/103* (2013.01); *E21B 17/14* (2013.01); *E21B 21/00* (2013.01); *E21B 21/08* (2013.01); *E21B 21/12* (2013.01); *E21B 23/01* (2013.01); *E21B 23/06* (2013.01); *E21B 33/127* (2013.01); *E21B 43/08* (2013.01); *E21B 43/18* (2013.01)

(58) Field of Classification Search

CPC ..... E21B 21/00; E21B 21/08; E21B 21/12; E21B 23/01; E21B 23/06; E21B 43/08; E21B 43/18

See application file for complete search history.

(56) References Cited

U.S. PATENT DOCUMENTS

| | | | |
|---|---|---|---|
| 5,117,915 A | 6/1992 | Mueller et al. | |
| 2004/0084182 A1 | 5/2004 | Edgar et al. | |
| 2006/0042798 A1 | 3/2006 | Badalamenti et al. | |
| 2007/0246225 A1 | 10/2007 | Hailey et al. | |
| 2014/0182861 A1 | 7/2014 | Wood et al. | |
| 2014/0251609 A1* | 9/2014 | Broussard | E21B 43/04 166/278 |

OTHER PUBLICATIONS

International Search Report and Written Opinion for International Applicaiton No. PCT/US2018/062548; International Filing Date Nov. 27, 2018; Report dated Mar. 12, 2019 (pp. 1-10).

* cited by examiner

*Primary Examiner* — Tara E Schimpf

(74) *Attorney, Agent, or Firm* — Cantor Colburn LLP

(57) ABSTRACT

A downhole system includes a first tubular having a first end, a second end, and an intermediate portion having an inner surface defining an interior. The second end includes one of a screen liner and a casing shoe. A second tubular is coupled to the first end of the first tubular. The second tubular includes a terminal end portion, a second end portion and a ported zone arranged between the terminal end portion and the second end portion. The terminal end portion and the ported zone extend into the interior of the first tubular. A packer member is arranged on the second tubular between the terminal end portion and the ported zone. The packer member is selectively expandable to seal against the inner surface to fluidically isolate the one of the screen liner and casing shoe from the ported zone.

15 Claims, 3 Drawing Sheets

SHOE ISOLATION SYSTEM AND METHOD FOR ISOLATING A SHOE

BACKGROUND

In the resource extraction and recovery industry, boreholes may be formed in a resource bearing formation. In some cases, a screen liner or casing is guided into the borehole. A terminal end of the screen liner or casing may include a guide shoe. The guide shoe may include a check valve or an opening that allows fluids, such as circulation fluid, to exit. At certain times, it may be desirable to close the shoe in two directions in order to enable a pressure differential to be created across the shoe or to force all fluids to exit through the screen liner radially outwardly with no fluids passing through the shoe.

Various systems and tools exist that enable operators to close a shoe in such applications. Typically, the tools are complex, long, and costly and at times, unreliable to utilize. Further, manipulating mechanical components arranged at a terminal end of the screen liner or casing is simply a difficult task. Therefore, the art would be appreciative of a system for selectively closing a shoe without the need to physically manipulate mechanical components with tools.

SUMMARY

Disclosed is a downhole system including a first tubular having a first end, a second end, and an intermediate portion having an inner surface defining an interior. The second end includes one of a screen liner and a casing shoe. A second tubular is coupled to the first end of the first tubular. The second tubular includes a terminal end portion, a second end portion and a ported zone arranged between the terminal end portion and the second end portion. The terminal end portion and the ported zone extend into the interior of the first tubular. A packer member is arranged on the second tubular between the terminal end portion and the ported zone. The packer member is selectively expandable to seal against the inner surface to fluidically isolate the one of the screen liner and casing shoe from the ported zone.

Also disclosed is a resource exploration and recovery system including a first system, and a second system including a tubular string connected to the first system. The tubular string includes a first tubular having a first end, a second end, and an intermediate portion having an inner surface defining an interior. The second end includes one of a screen liner and a casing shoe. A second tubular is coupled to the first end of the first tubular. The second tubular includes a terminal end portion, a second end portion and a ported zone arranged between the terminal end portion and the second end portion. The terminal end portion and the ported zone extend into the interior of the first tubular. A packer member is arranged on the second tubular between the terminal end portion and the ported zone. The packer member is selectively expandable to seal against the inner surface to fluidically isolate the one of the screen liner and casing shoe from the ported zone.

Further discloses is a method of fluidically isolating a casing shoe including passing a fluid into a first tubular of a tubular string, flowing the fluid into a second tubular of the tubular string, passing the fluid through one of a screen liner and a casing shoe arranged at a terminal end of the second tubular, and expanding a packer mounted to the first tubular to fluidically isolate the one of the screen liner and the casing shoe from the tubular string.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
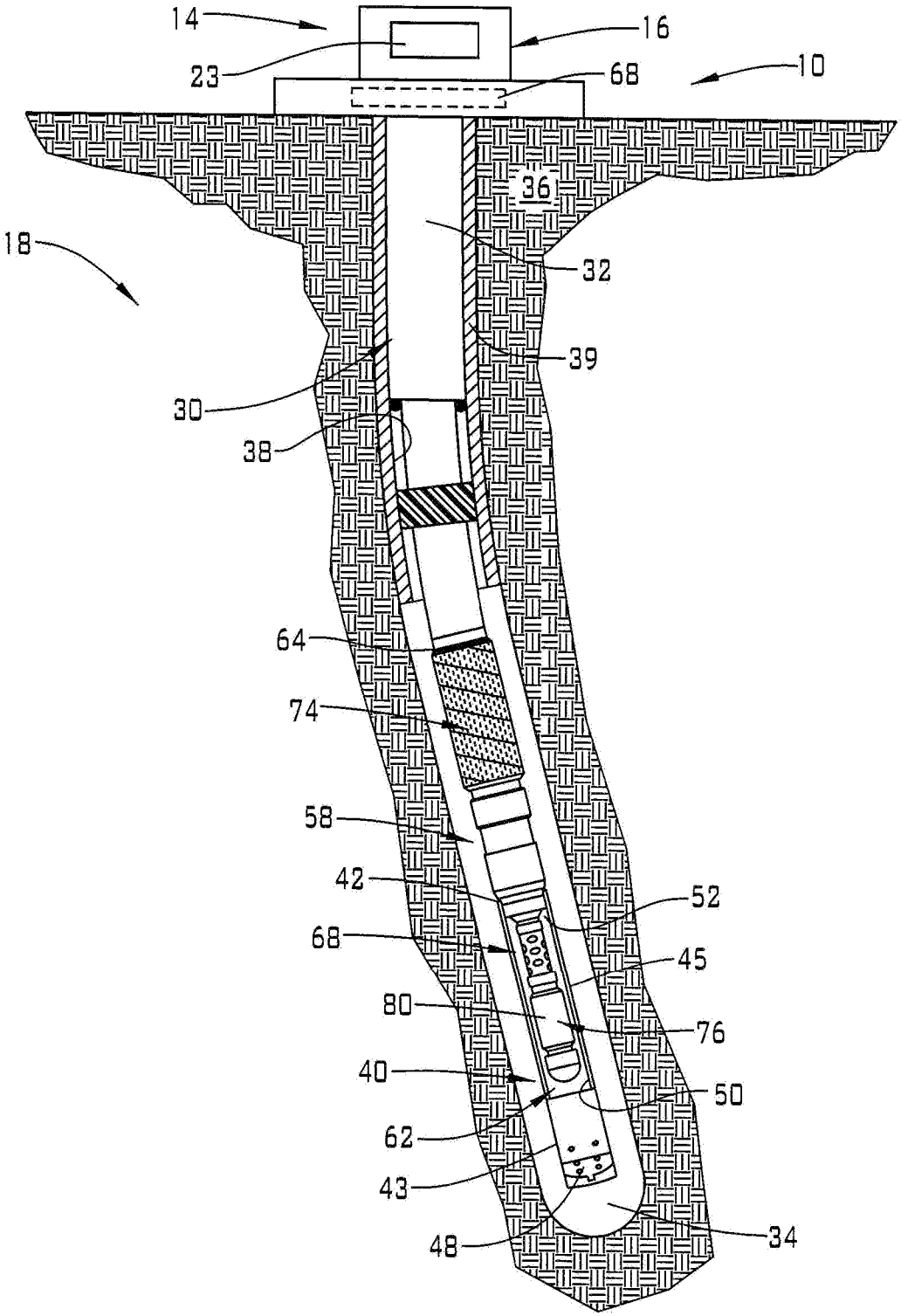
FIG. 1 depicts a resource exploration and recovery system including a shoe isolation system, in accordance with an aspect of an exemplary embodiment.

A resource exploration and recovery system, in accordance with an exemplary embodiment, is indicated generally at 10, in FIG. 1. Resource exploration and recovery system 10 should be understood to include well drilling operations, resource extraction and recovery, $CO_2$ sequestration, and the like. Resource exploration and recovery system 10 may include a first system 14 which, in some environments, may take the form of a surface system 16 operatively and fluidically connected to a second system 18 which, in some environments, may take the form of a downhole system. First system 14 may include a control system 23 that may provide power to, monitor, communicate with, and/or activate one or more downhole operations as will be discussed herein. Surface system 16 may include additional systems such as pumps, fluid storage systems, cranes and the like.

Second system 18 may include a tubular string 30 formed from a plurality of tubulars, one of which is indicated at 32 that is extended into a wellbore 34 formed in formation 36 or tubular string may represent a continuous tubular such as coiled tubing. Wellbore 34 includes an annular wall 38 which may be defined by a surface of formation 36, or a casing tubular 39 such as shown. Tubular string 30 includes a first tubular 40 having a first end 42, a second end 43 and an intermediate portion 45. First tubular 40 may be a distinct tubular member or a portion of coiled tubing forming tubular string 30. Second end 43 supports a screen liner or casing shoe 48 having one or more openings (not separately labeled) that fluidically connect to wellbore 34. First tubular 40 includes an inner surface 50 that defines, at least in part, an interior 52.

Figure 2:
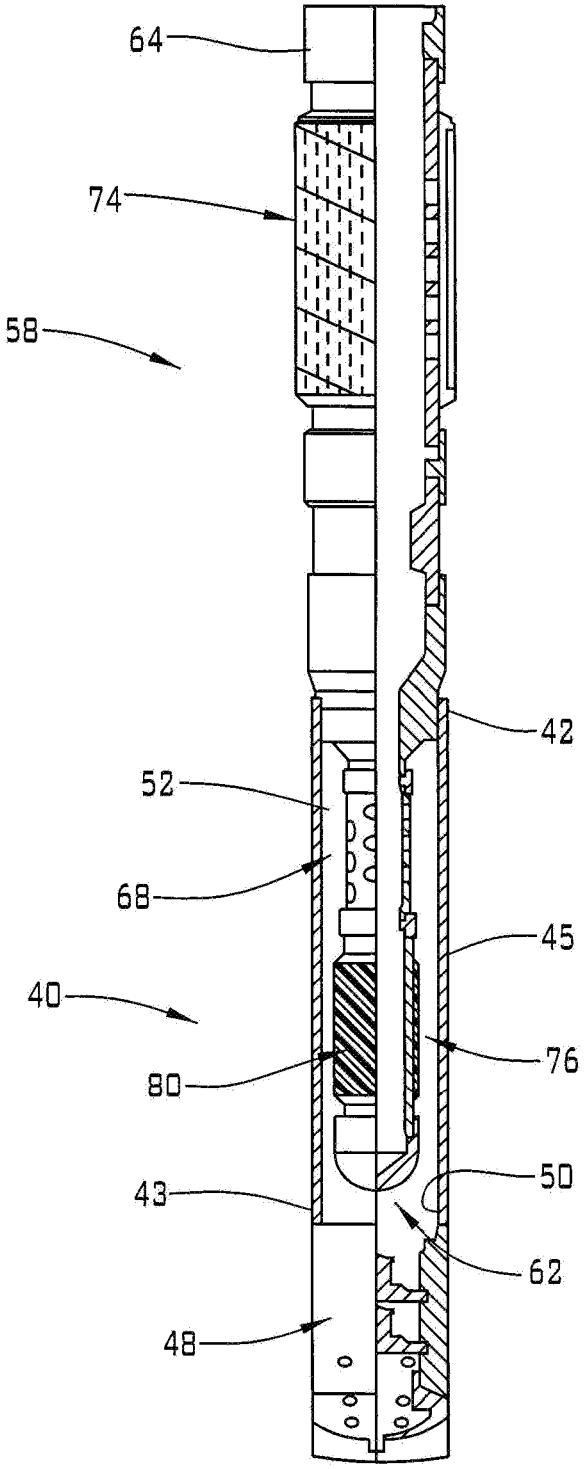
FIG. 2 depicts the shoe isolation system, in accordance with an exemplary aspect, in a non-deployed configuration.

Tubular string 30 also includes a second tubular 58 that may form part of, or be connected with, tubulars 32. Referring to FIG. 2, second tubular 58 includes a terminal end portion 62 and an uphole or second end portion 64. A ported zone 68 having a plurality of ports (not separately labeled) is arranged between terminal end portion 62 and second end portion 64. Ported zone 68 may selectively fluidically connect a fluid path (not shown) of tubular string 30 with wellbore 34. Terminal end portion 62 and ported zone 68 are arranged in interior 52 of first tubular 40. Second tubular 58 also supports a screen assembly 74 that may be arranged at second end portion 64. The particular location of screen assembly 74 may vary.

Figure 3:
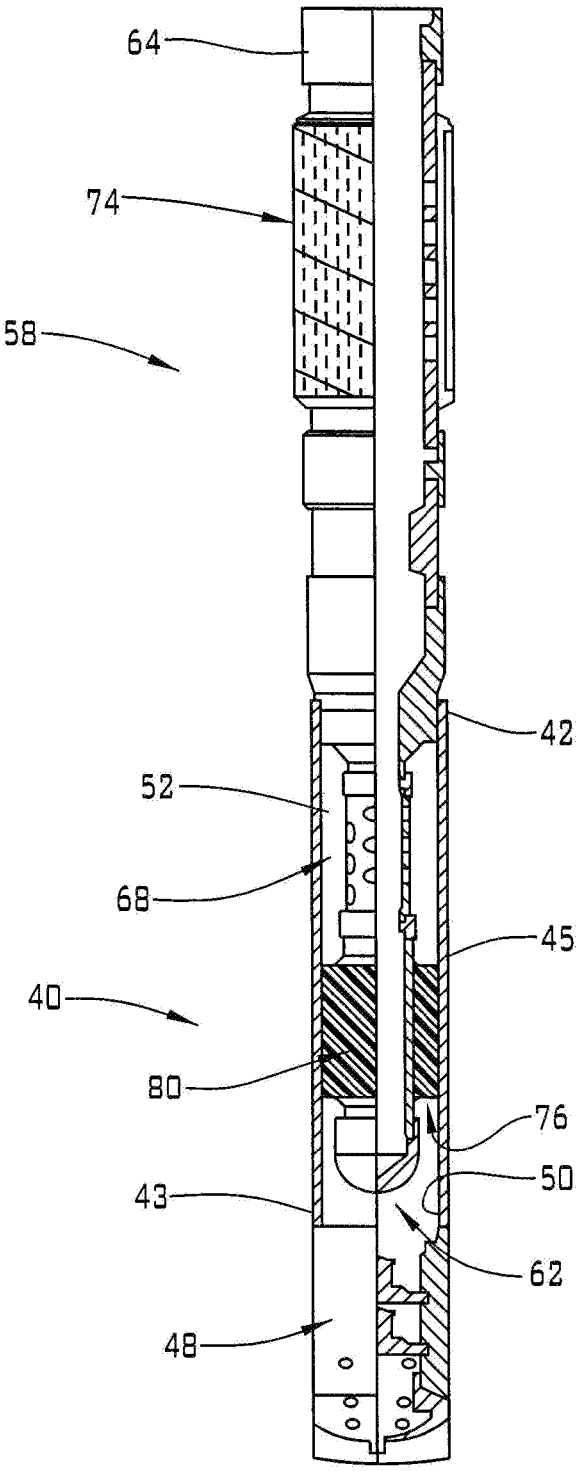
FIG. 3 depicts the shoe isolation system of FIG. 2 in a deployed configuration.

During various downhole operations, it may be desirable to circulate fluid through ported zone 68 into wellbore 34 via screen liner or casing shoe 48. During other, often subsequent downhole operations, it is desirable to prevent fluids from passing outwardly of shoe 48. Accordingly, second tubular 58 includes a shoe isolation system 76 arranged downhole relative to ported zone 68. Shoe isolation system 76 includes a selectively expandable packer member 80 that may expand radially outwardly against inner surface 50 of first tubular 40 such as shown in FIG. 3. When expanded, packer member 80 fluidically isolates shoe 48 from ported zone 68.

In accordance with an aspect of an exemplary embodiment, packer member 80 may be formed from a material that is reactive to fluids and/or temperature. For example, packer member 80 may be formed from a material that is reactive when exposed to downhole fluids, e.g., fluids that may exist in formation 36, e.g., formation fluids and/or fluids that are formed based on a reaction between fluids introduced into wellbore 34 from first system 14 and formation 36. In accordance with other aspects of an exemplary embodiment, packer material may be reactive to fluids that are introduced at first system 14. Further, packer member 80 may be reactive to changes in temperature in addition, or as an alternative, to being reactive to fluids. It should however be understood that packer member 80 could be mechanically actuated.

Set forth below are some embodiments of the foregoing disclosure:

Embodiment 1

A downhole system including a first tubular having a first end, a second end, and an intermediate portion having an inner surface defining an interior, the second end including one of a screen liner and a casing shoe. A second tubular coupled to the first end of the first tubular, the second tubular including a terminal end portion, a second end portion and a ported zone arranged between the terminal end portion and the second end portion, the terminal end portion and the ported zone extending into the interior of the first tubular; and a packer member arranged on the second tubular between the terminal end portion and the ported zone, the packer member being selectively expandable to seal against the inner surface to fluidically isolate the one of the screen liner and casing shoe from the ported zone.

Embodiment 2

The downhole system in any prior embodiment, wherein the packer member is formed from a material that reacts when exposed to downhole fluids.

Embodiment 3

The downhole system according to any prior embodiment, wherein the downhole fluids include formation fluids.

Embodiment 4

The downhole system according to any prior embodiment, further comprising: a screen assembly arranged between the ported zone and the second end.

Embodiment 5

The downhole system according to any prior embodiment wherein the screen assembly is arranged axially outwardly of the interior.

Embodiment 6

A resource exploration and recovery system including a first system; and a second system including a tubular string connected to the first system. The tubular string including a first tubular having a first end, a second end, and an intermediate portion having an inner surface defining an interior, the second end including one of a screen liner and a casing shoe. A second tubular coupled to the first end of the first tubular, the second tubular including a terminal end portion, a second end portion and a ported zone arranged between the terminal end portion and the second end portion, the terminal end portion and the ported zone extending into the interior of the first tubular; and a packer member arranged on the second tubular between the terminal end portion and the ported zone, the packer member being selectively expandable to seal against the inner surface to fluidically isolate the one of the screen liner and the casing shoe from the ported zone.

Embodiment 7

The resource exploration and recovery system according to any prior embodiment, wherein the packer member is formed from a material that reacts when exposed to downhole fluids.

Embodiment 8

The resource exploration and recovery system according to any prior embodiment, wherein the downhole fluids include formation fluids.

Embodiment 9

The resource exploration and recovery system according to any prior embodiment, further comprising: a screen assembly arranged between the ported zone and the second end.

Embodiment 10

The resource exploration and recovery system according to any prior embodiment, wherein the screen assembly is arranged axially outwardly of the interior.

Embodiment 11

A method of fluidically isolating a casing shoe including passing a fluid into a first tubular of a tubular string; flowing the fluid into a second tubular of the tubular string; passing the fluid through one of a screen liner and a casing shoe arranged at a terminal end of the second tubular; and expanding a packer mounted to the first tubular to fluidically isolate the one of the screen liner and the casing shoe from the tubular string.

Embodiment 12

The method of any prior embodiment, wherein expanding the packer includes exposing the packer to a selected fluid.

Embodiment 13

The method of any prior embodiment, wherein exposing the packer to the selected fluid includes exposing the packer to downhole fluids.

Embodiment 14

The method of any prior embodiment, wherein exposing the packer to the selected fluid includes exposing the packer to a fluid introduced into the tubular string.

Embodiment 15

The method of any prior embodiment, wherein flowing the fluid into the second tubular includes passing the fluid through a plurality of ports formed in the first tubular.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, gravel packing, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A downhole system comprising:

a first tubular having a first end, a second end, and an intermediate portion having an inner surface defining an interior, the second end including one of a screen liner and a casing shoe;

a second tubular coupled to the first end of the first tubular, the second tubular including a terminal end portion, a second end portion and a ported zone arranged between the terminal end portion and the second end portion, the terminal end portion and the ported zone extending into the interior of the first tubular; and a packer member arranged on the second tubular between the terminal end portion and the ported zone, the packer member being selectively expandable to seal against the inner surface to fluidically isolate the one of the screen liner and casing shoe from the ported zone.

2. The downhole system according to claim 1, wherein the packer member is formed from a material that reacts when exposed to downhole fluids.

3. The downhole system according to claim 2, wherein the downhole fluids include formation fluids.

4. The downhole system according to claim 1, further comprising: a screen assembly arranged between the ported zone and the second end.

5. The downhole system according to claim 4, wherein the screen assembly is arranged axially outwardly of the interior.

6. A resource exploration and recovery system comprising:

a first system; and a second system including a tubular string connected to the first system, the tubular string comprising:

a first tubular having a first end, a second end, and an intermediate portion having an inner surface defining an interior, the second end including one of a screen liner and a casing shoe;

a second tubular coupled to the first end of the first tubular, the second tubular including a terminal end portion, a second end portion and a ported zone arranged between the terminal end portion and the second end portion, the terminal end portion and the ported zone extending into the interior of the first tubular; and a packer member arranged on the second tubular between the terminal end portion and the ported zone, the packer member being selectively expandable to seal against the inner surface to fluidically isolate the one of the screen liner and the casing shoe from the ported zone.

7. The resource exploration and recovery system according to claim 6, wherein the packer member is formed from a material that reacts when exposed to downhole fluids.

8. The resource exploration and recovery system according to claim 7, wherein the downhole fluids include formation fluids.

9. The resource exploration and recovery system according to claim 6, further comprising: a screen assembly arranged between the ported zone and the second end.

10. The resource exploration and recovery system according to claim 9, wherein the screen assembly is arranged axially outwardly of the interior.

11. A method of fluidically isolating a casing shoe comprising:

passing a fluid into a first tubular of a tubular string;

flowing the fluid from the first tubular into a second tubular of the tubular string;

passing the fluid through one of a screen liner and a casing shoe arranged at a terminal end of the first tubular; and expanding a packer mounted to the second tubular to fluidically isolate the one of the screen liner and the casing shoe from portions of the tubular string uphole of the packer.

12. The method of claim 11, wherein expanding the packer includes exposing the packer to a selected fluid.

13. The method of claim 12, wherein exposing the packer to the selected fluid includes exposing the packer to downhole fluids.

14. The method of claim 12, wherein exposing the packer to the selected fluid includes exposing the packer to a fluid introduced into the tubular string.

15. The method of claim 11, wherein flowing the fluid into the second tubular includes passing the fluid through a plurality of ports formed in the first tubular.

* * * * *